US006983511B2

(12) United States Patent
Massaro

(10) Patent No.: US 6,983,511 B2
(45) Date of Patent: Jan. 10, 2006

(54) MULTIPURPOSE TOOL FOR CLEANING MACHINES

(75) Inventor: Michele Massaro, Noventa Padovana (IT)

(73) Assignee: Lindhaus S.R.L., Padova (IT)

( * ) Notice: Subject to any disclaimer, the term of this patent is extended or adjusted under 35 U.S.C. 154(b) by 0 days.

(21) Appl. No.: 10/155,033

(22) Filed: May 28, 2002

(65) Prior Publication Data

US 2002/0178534 A1 Dec. 5, 2002

(30) Foreign Application Priority Data

May 31, 2001 (IT) ..... PD2001A0125

(51) Int. Cl.
*A47L 9/04* (2006.01)

(52) U.S. Cl. ..... 15/338; 15/328; 15/378; 15/422

(58) Field of Classification Search ..... 15/364, 15/378, 412, 328, 338, 377, 401, 402, 414, 15/420, 422
See application file for complete search history.

(56) References Cited

U.S. PATENT DOCUMENTS 1,296,121 A * 3/1919 Rosenfield ..... 15/393
1,657,111 A * 1/1928 Desnoyers ..... 15/393
4,700,428 A * 10/1987 Hetherington ..... 15/338
5,101,534 A * 4/1992 Watanabe et al. ..... 15/401
5,819,366 A * 10/1998 Edin ..... 15/401
6,101,668 A * 8/2000 Grey ..... 15/401

* cited by examiner

*Primary Examiner*—Theresa T. Snider
(74) *Attorney, Agent, or Firm*—Guido Modiano; Albert Josif; Daniel O'Byrne

(57) ABSTRACT

A multipurpose tool for cleaning machines, having a body that is interchangeably associable with a cleaning machine provided with an electric motor; the body is movable on wheels and a front advancement part thereof is arranged transversely to a main direction of motion so as to form a housing that is open downward and accommodates a bristled roller that is moved, by virtue of transmission elements, by an electric motor accommodated within the body; the body is articulated to a coupling element that is suitable to provide a detachable connection to the machine with a dirt suction duct. The tool further includes a pair of interchangeable covers that are selectively detachably associable below the housing at an open region where the roller is located, each of the covers having at least one suction slot and elements for closing the region to the rear of the roller between the housing and the floor.

7 Claims, 4 Drawing Sheets

SKETCH

SKETCH

MULTIPURPOSE TOOL FOR CLEANING MACHINES

BACKGROUND OF THE INVENTION

The present invention relates to a multipurpose tool for cleaning machines.

The tool is particularly suitable for carpet sweepers with one or two motors.

Tools suitable only for removing dust are known which are constituted by a box-like body that can move on wheels and in which the front advancement part lies transversely to the main direction of motion so as to form a housing that rotatably accommodates a bristled brushing roller that is moved at high speed (on the order of 2,000 to 5,000 rpm), by virtue of transmission means, by an electric motor accommodated within the box-like body.

Such body is articulated to a coupling element that is suitable to provide the detachable connection to the cleaning machine by means of a duct for aspirating the dirt removed by the roller.

Such tools are suitable only for use on carpets or fitted carpeting, since otherwise the high rotation rate of the brush, required to remove the dirt from the pile, on hard floors would spread the dirt more, producing the opposite of the intended effect.

SUMMARY OF THE INVENTION

The aim of the present invention is to provide a tool that by way of simple and rapid operations can be converted from a tool for removing dust and dirt from fitted carpeting and/or carpets or the like into a tool for removing dust and dirt from smooth floors.

Within this aim, an object of the present invention is to provide a tool that is easy to use even for non-specialized users.

Another important object is to reduce the number of accessories for cleaning machines.

Another object of the present invention is to provide an apparatus that can be manufactured with known technologies.

This aim and these and other objects that will become better apparent hereinafter are achieved by a multipurpose tool for cleaning machines, which comprises a box-like body that is interchangeably associable with a cleaning machine provided with an electric motor, said box-like body being movable on wheels, a front advancement part thereof being arranged transversely to a main direction of motion so as to form a housing that is open downward and accommodates a bristled roller that is moved, by virtue of transmission means, by an electric motor accommodated within the body, said body being articulated to a coupling element that is suitable to provide a detachable connection to the machine with a dirt suction duct, said tool being characterized in that it comprises a cover that is detachably associable below said housing at an open region where said roller is located, said cover having at least one suction slot and means for closing the region to the rear of said roller between the housing and the floor.

BRIEF DESCRIPTION OF THE DRAWINGS

Further characteristics and advantages of the present invention will become better apparent from the following detailed description of two embodiments thereof, illustrated only by way of non-limitative example in the accompanying drawings, wherein.

DESCRIPTION OF THE PREFERRED EMBODIMENTS

Figure 1:
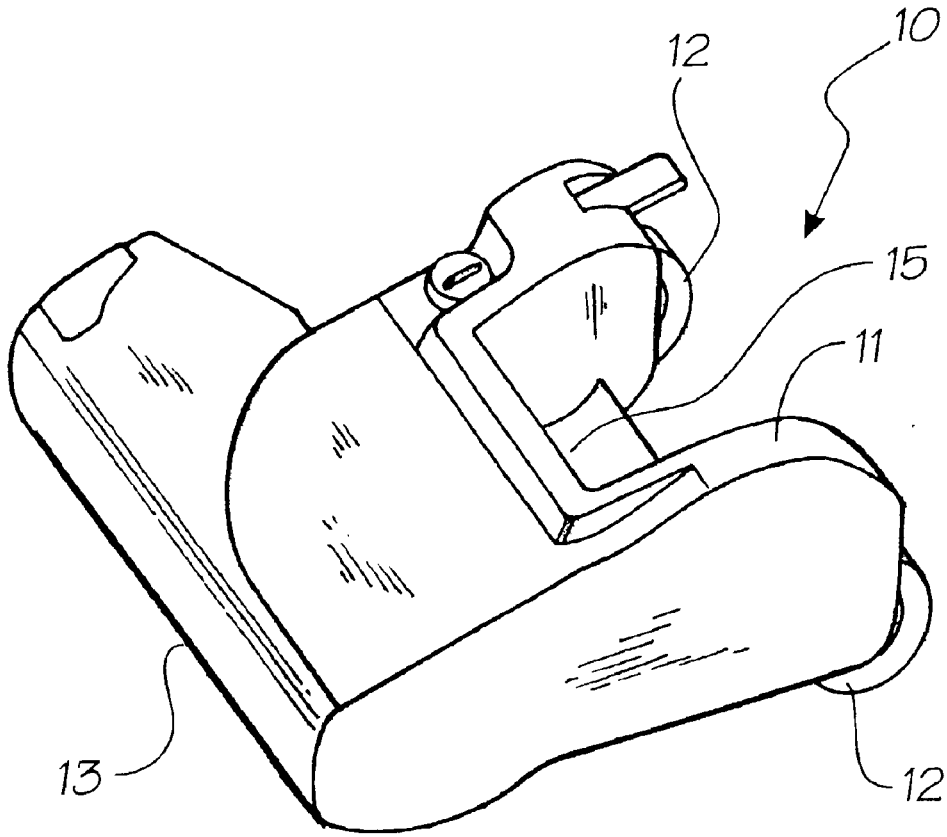
FIG. 1 is a perspective view of a tool according to the present invention.
Figure 2:
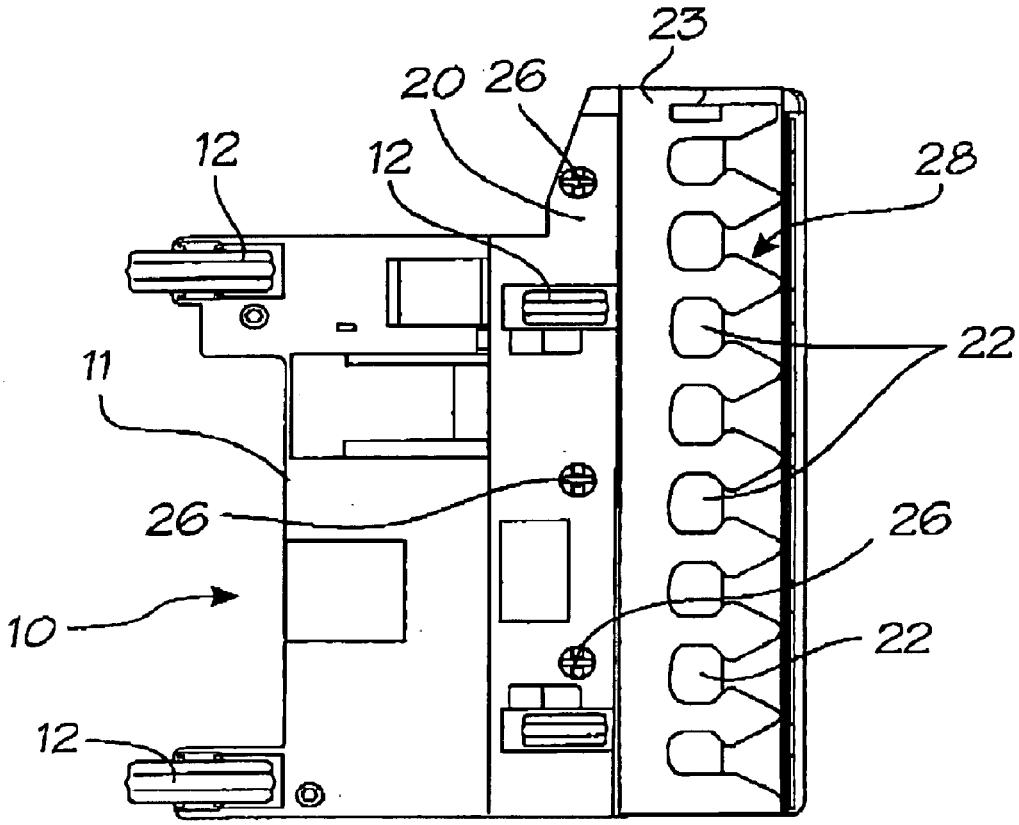
FIG. 2 is a bottom view of the tool of FIG. 1 in a first configuration.
Figure 3:
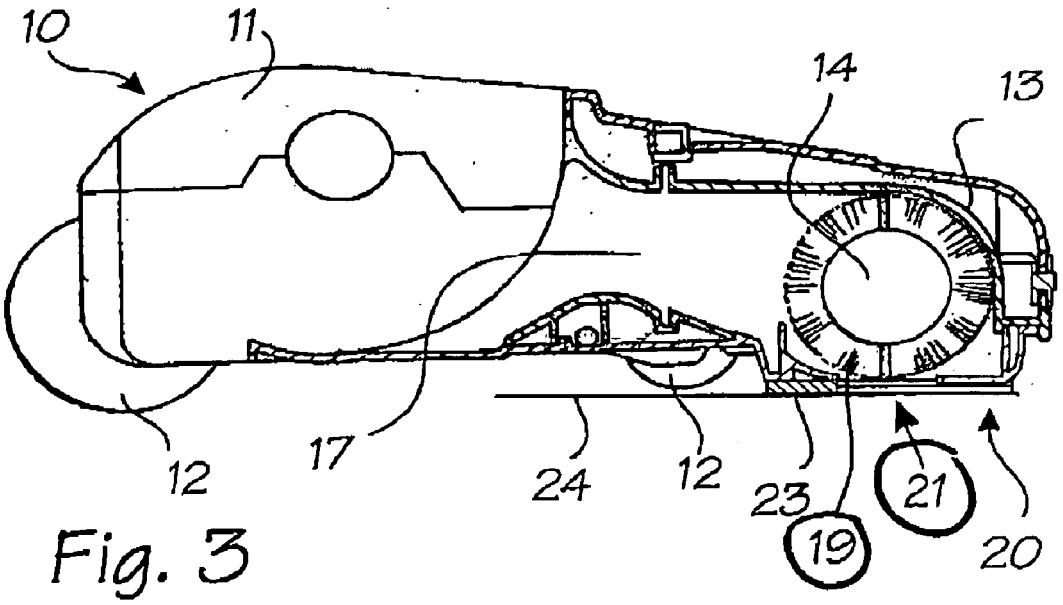
FIG. 3 is a partially sectional side view of the tool in the configuration of FIG. 2.
Figure 4:
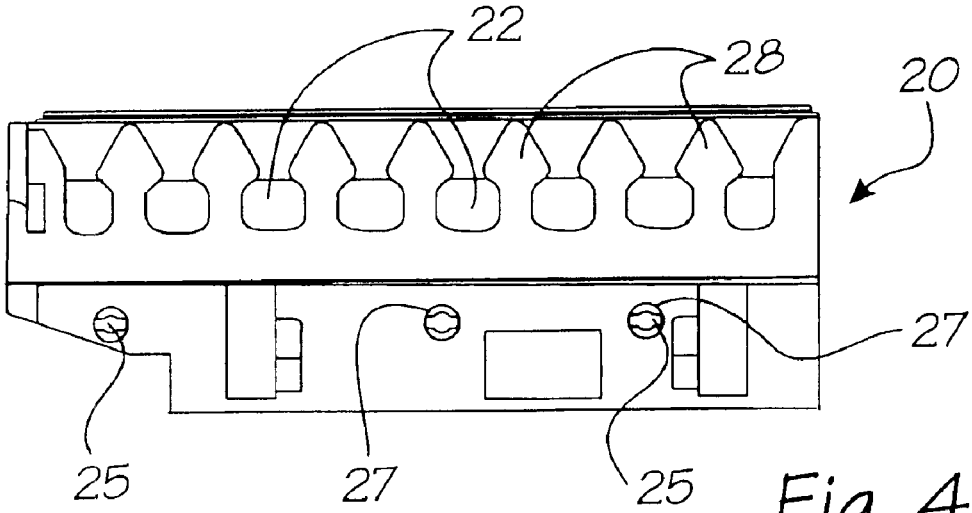
FIGS. 4 and 5 are sectional bottom views of a cover used in the first configuration.
Figure 5:
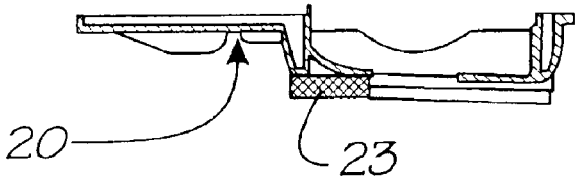

With reference to FIGS. 1 to 5, a tool according to the invention is generally designated by the reference numeral 10.

The tool 10 is interchangeably associable with a cleaning machine, for example a vacuum cleaner, not shown, which is adequately provided with an electric motor.

Moreover, the tool 10 comprises a box-like body 11, which in this case is made of plastics, that can move on four wheels 12 arranged in pairs; the front advancement part of the body lies transversely to a main direction of motion so as to form a housing 13 that is open in a downward region, is wider than the remainder of the box-like body 11, and rotatably accommodates a bristled roller 14.

The roller 14 is moved, by virtue of belt drive means, by an electric motor, not shown in the figures, that is accommodated within the box-like body 11.

The box-like body 11 is articulated to a coupling element 15, which is suitable to provide the detachable connection to the cleaning machine and incorporates means for electrical connection to the electrical mains for the electric motor, said means being constituted in this case by a plug, not shown in the figures.

The coupling element 15 has, in this case, a tubular cavity 17, which leads into the region of the roller 14 and is suitable to be associated with the tubular stem of the machine that constitutes a suction duct.

The roller 14, in this embodiment, comprises bristles 19, which are arranged according to a geometry that converges at the center.

According to the invention, the tool 10 comprises a cover 20, which is detachably associable below the housing 13 at the open region 21 where the roller 14 is located.

The cover 20 has, in this case, a comb-like front shape (with arrow-shaped teeth 28), which forms a set of suction slots 22, and a covering felt 23, which constitutes a means for closing the region to the rear of the roller 14 between the housing 13 and the floor 24.

The felt 23, which follows the profile of the cover 20, also constitutes an element for resting on the floor 24 that is particularly suitable for delicate floors, such as wood floors, and allows to polish while vacuuming.

In this case, the cover 20 has three slotted holes 25 for fixing it to the housing 13; the slotted holes lie transversely to a main direction of motion, and respective T-shaped elements 26 can be inserted therein and are rigidly coupled to the housing 13 in corresponding regions and can rotate about their own axis of symmetry between a position in which the head can pass through the respective hole 25 and a position in which said head straddles said hole.

The holes 25 are formed in recessed regions 27 of the housing 13.

Figure 8:
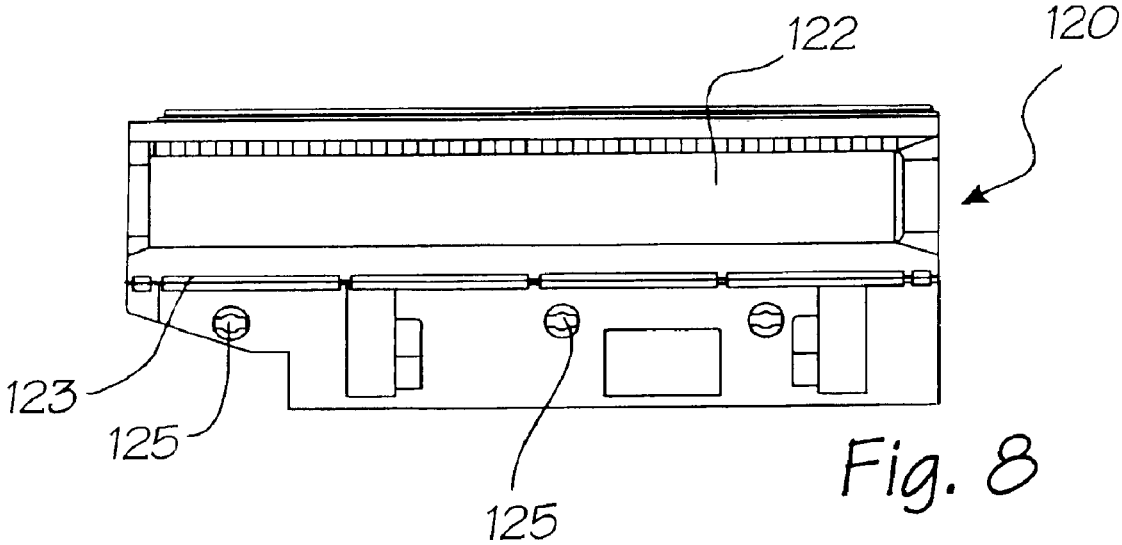
FIGS. 8 and 9 are sectional bottom views of a cover used in the second configuration.
Figure 9:
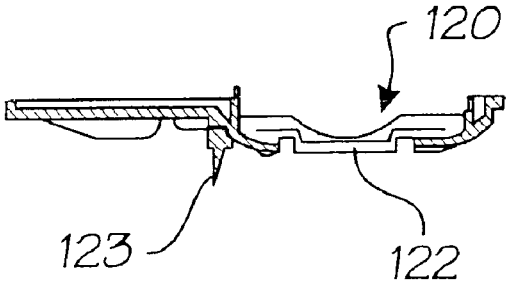
Figure 6:
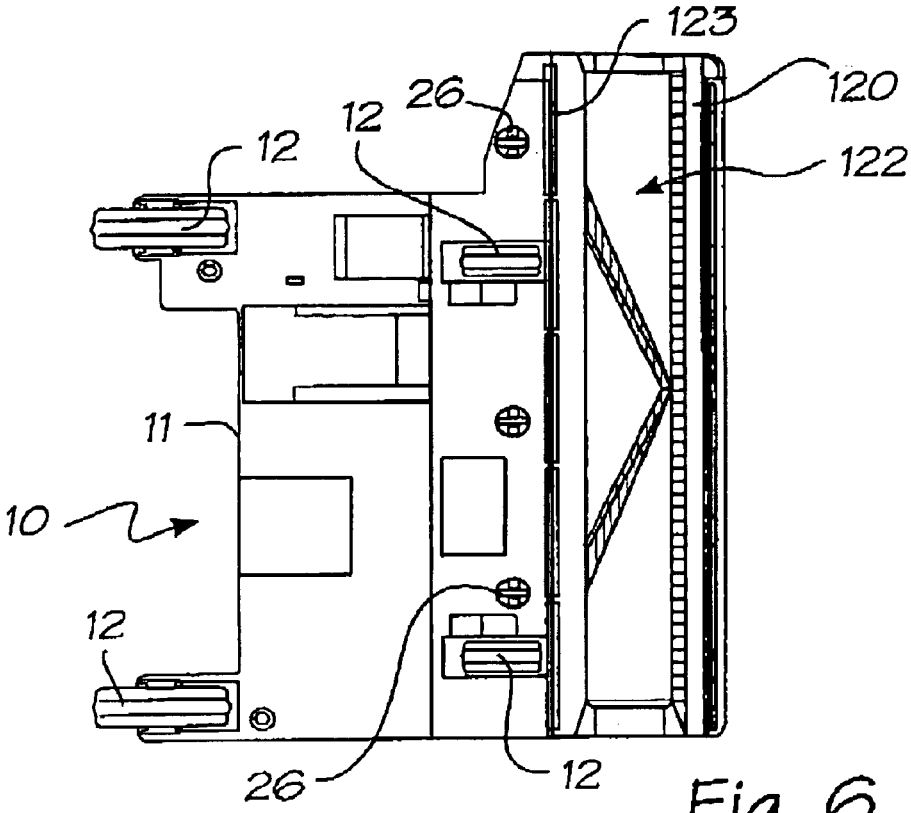
FIG. 6 is a bottom view of the tool of FIG. 1 in a second configuration.
Figure 7:
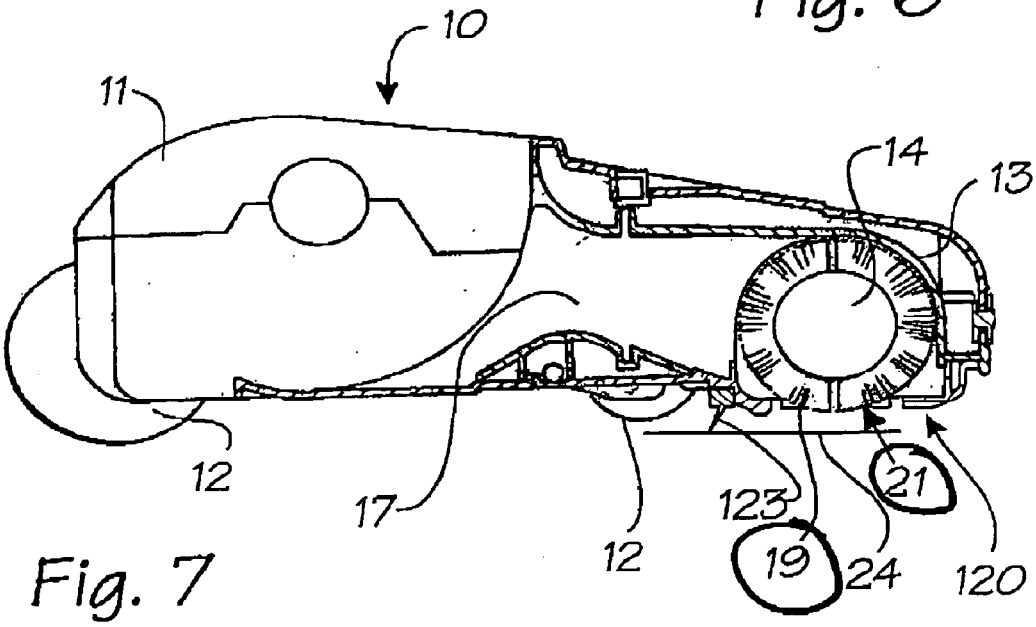
FIG. 7 is a partially sectional side view of the tool in the configuration of FIG. 6.
Figure 1:
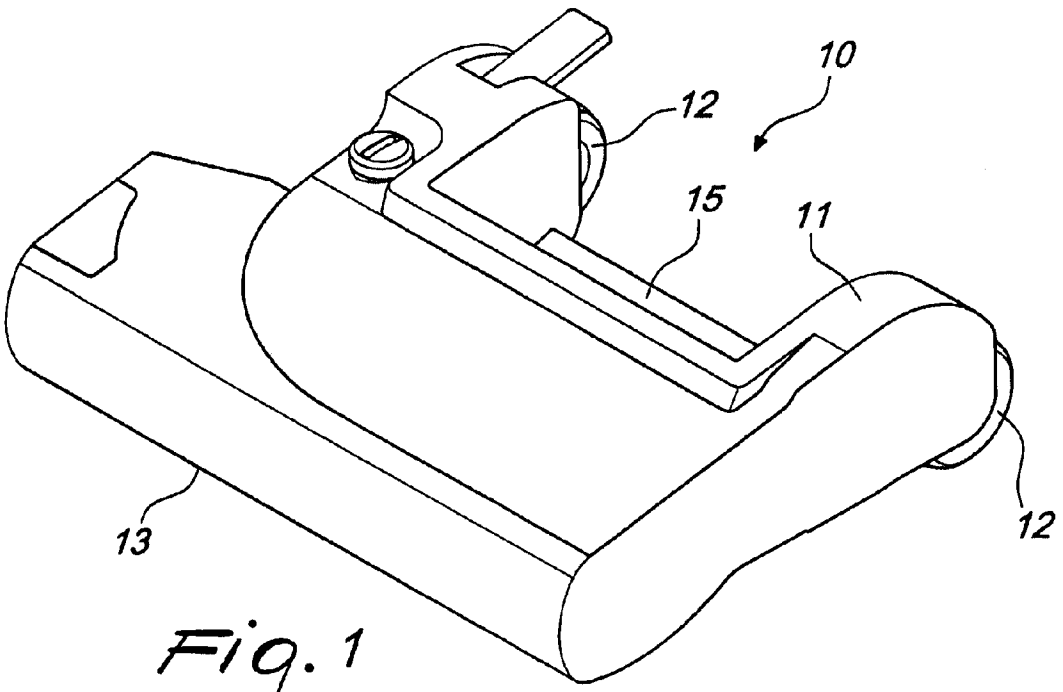
Figure 2:
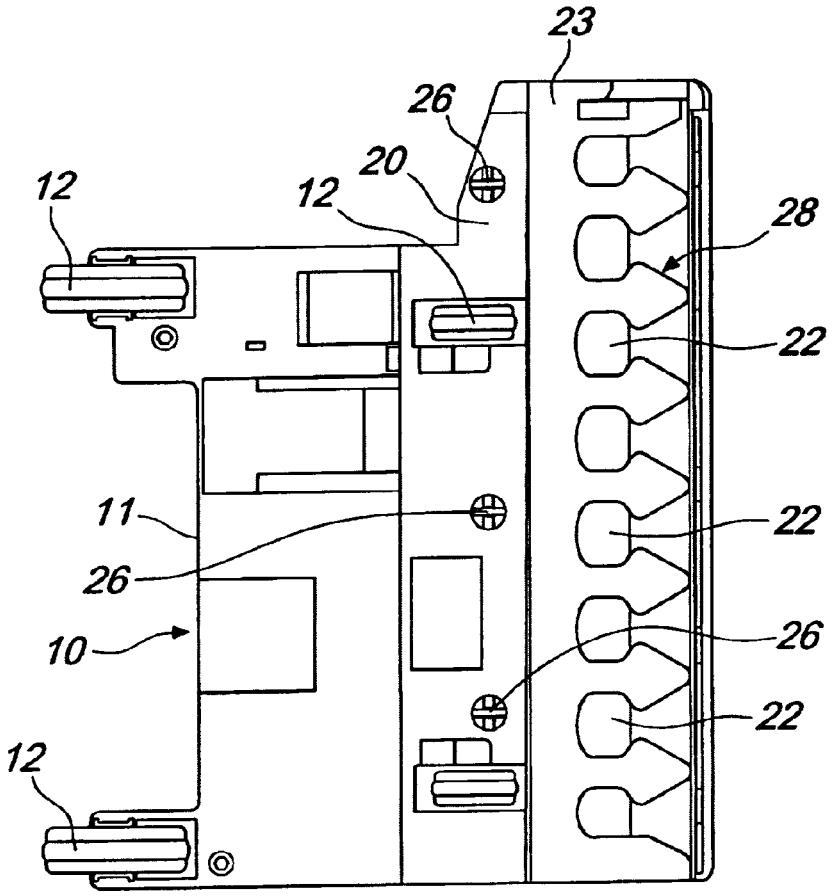
Figure 3:
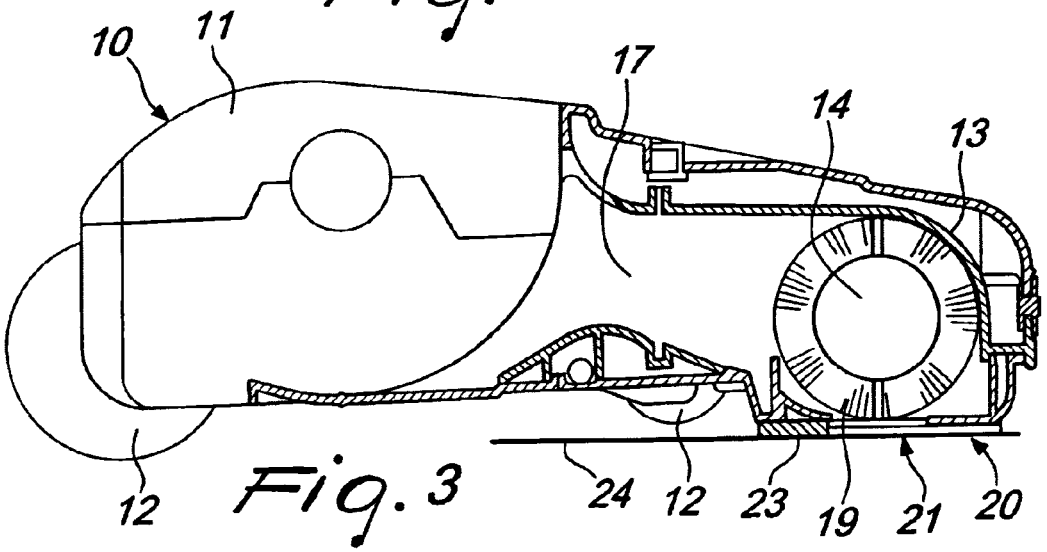
Figure 4:
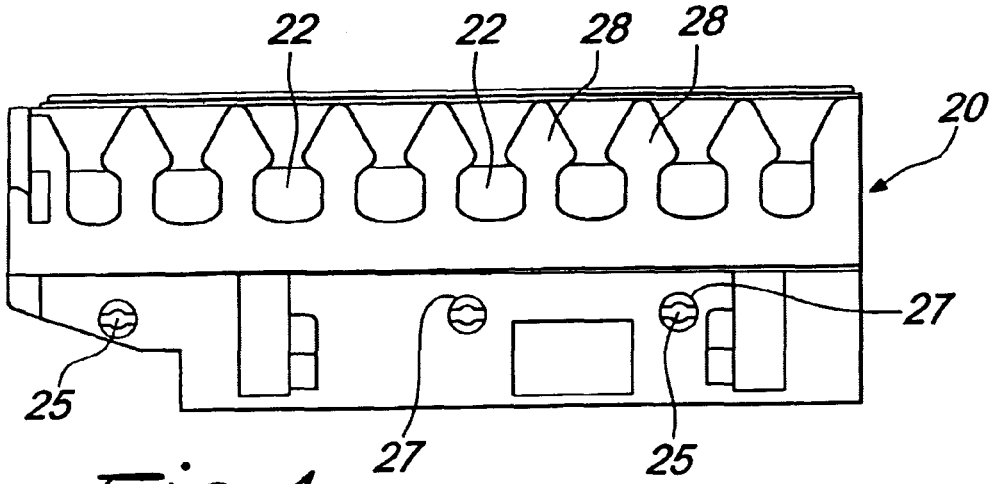
Figure 5:
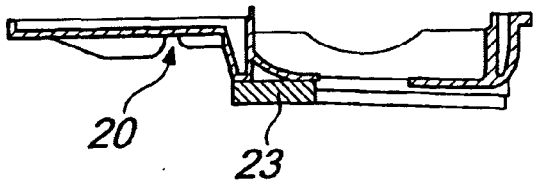
Figure 8:
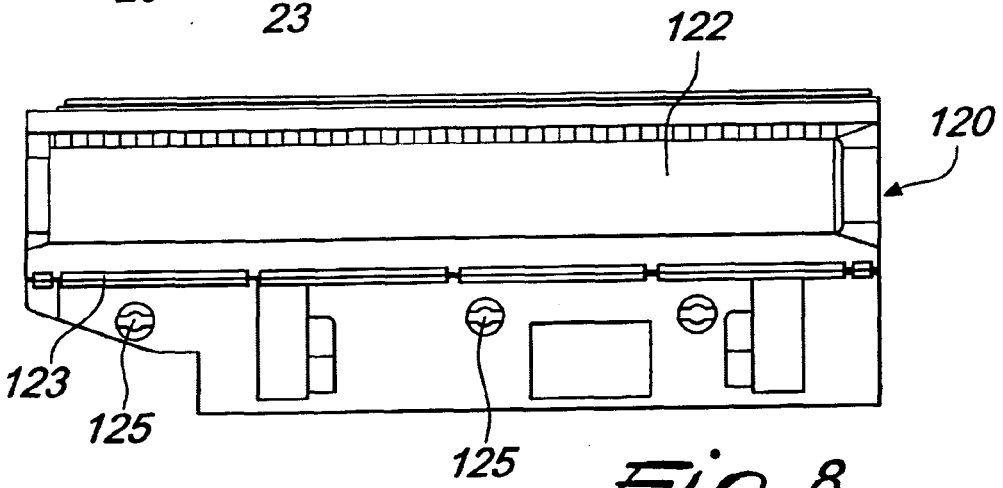
Figure 9:
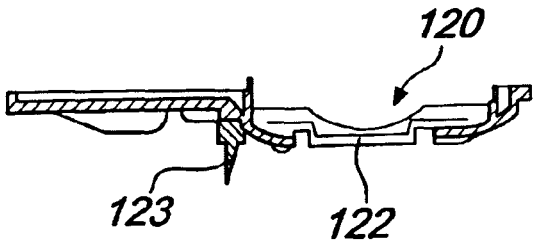
Figure 6:
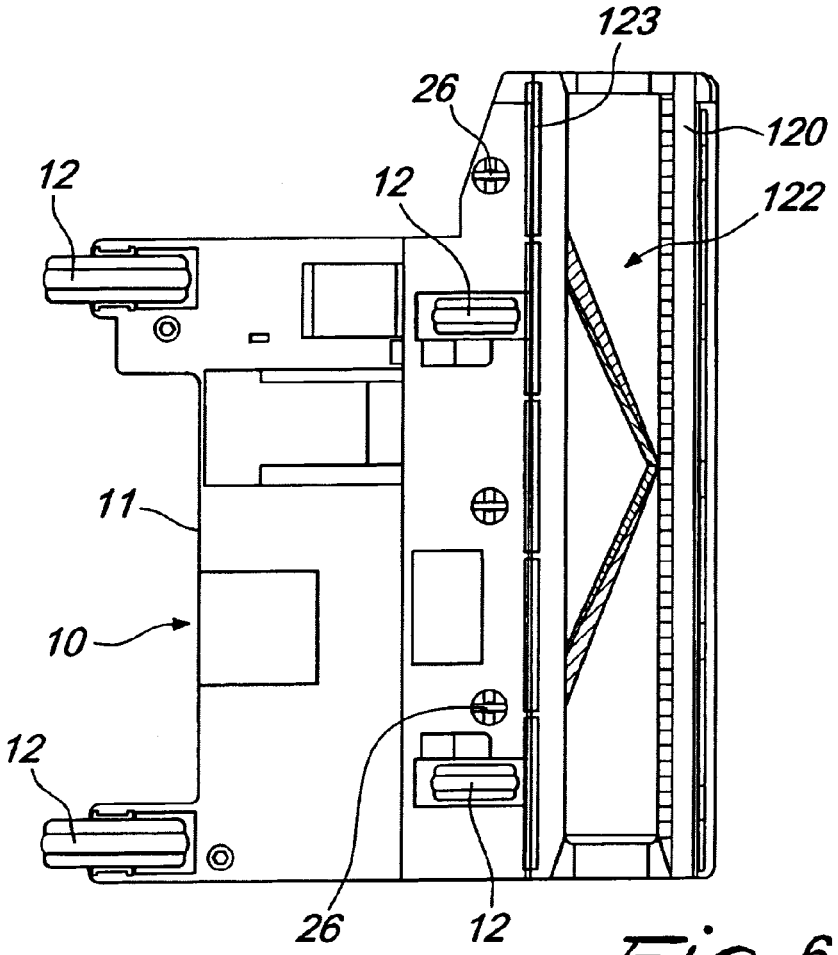
Figure 7:
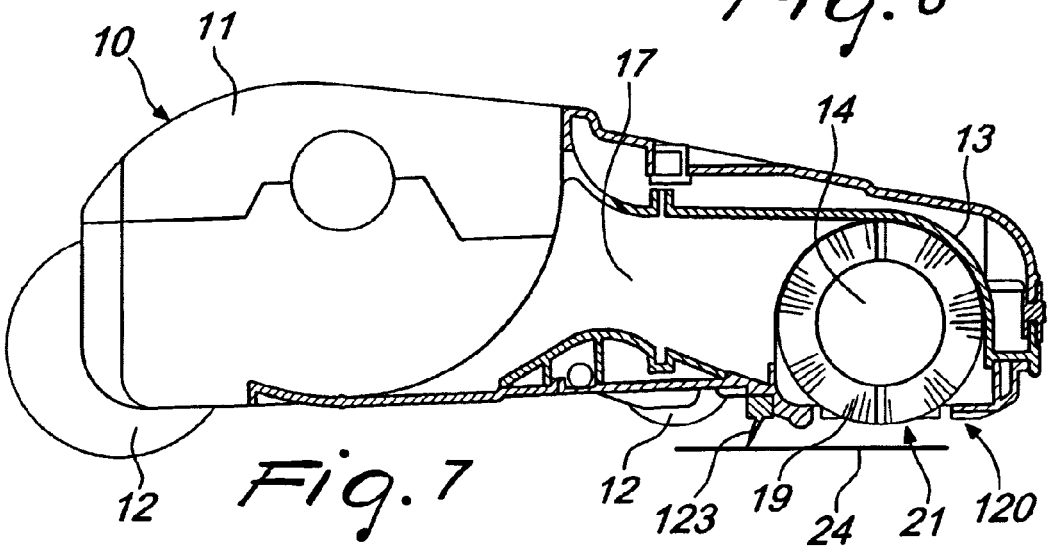

With reference now to FIGS. 6 to 9, the tool 10 also comprises a cover 120, which is detachably associable below the housing 13 at the open region 21 in which the roller 14 is located, so that the tool 10 may be selectively configured in a second configuration.

The cover 120 has, in this case, a single suction slot 122 (which lies transversely to the main direction of motion), and a lip 123 made of rubber or equivalent elastomeric material, which constitutes a means for closing the region to the rear of the roller 14 between the housing 13 and the floor 24.

The lip 123 rests on the floor 24 and flexes, and is particularly suitable for hard floors such as ceramics, terracotta, marble, et cetera.

In order to fix it to the housing 13, the cover 120 also is provided with three slotted holes 125, which lie transversely to the main direction of motion and in which said T-shaped elements 26, rigidly coupled to said housing 13, can be inserted.

In practice it has been observed that the present invention has achieved the intended aim and objects.

It is in fact noted that the tool according to the invention can be easily associated with a cleaning machine (for example a vacuum cleaner), which is only required to have an electric motor, and can be converted by means of simple and quick operations from a tool for removing dust and dirt from fitted carpeting and/or carpets or the like into a tool for removing dust and dirt from smooth floors.

In this manner, the user can purchase a cleaning machine that allows him to perform several operations, with a considerable saving in terms of purchase and maintenance costs and great advantages in terms of storage space saving.

The tool according to the invention combines the above features with high effectiveness in operation and great adaptability to various requirements of application in view of its structural flexibility and its adjustments.

The present invention is susceptible of numerous modifications and variations, all of which are within the scope of the inventive concept.

All the details may further be replaced with other technically equivalent elements.

In practice, the materials employed, so long as they are compatible with the contingent use, as well as the dimensions, may be any according to requirements.

The disclosures in Italian Patent Application No. PD2001A000125 from which this application claims priority are incorporated herein by reference.

What is claimed is:

1. A multipurpose tool for cleaning machines, comprising a box-like body that is interchangeably associable with a cleaning machine provided with an electric motor, said box-like body being movable on wheels connected to said box-like body, a first advancement part thereof being arranged transversely to a main direction of motion so as to form a housing that is open downward and accommodates a bristled roller that is moved, by virtue of transmission means, by an electric motor accommodated within the body, said body being articulated to a coupling element that is suitable to provide a detachable connection to the machine with a dirt suction duct, said tool further comprising:

a first cover that is detachably associable below said housing at an open region where said roller is located, said first cover having at least one first suction slot arranged below said roller and first closure means for closing the region to the rear of said roller between the housing and a floor, said cover having felt which, by resting on the floor, constitutes said first closure means for closing the region to the rear of said roller between the housing and the floor; and a second cover that is detachable associable below said housing at said open region where said roller is located when said first cover is removed, said second covet having at least one second suction slot arranged below said roller and second closure means for closing the region to the rear of said roller between the housing and the floor, said second cover having a lip made of rubber or equivalent elastomeric material that rests on the floor and constitutes said second closure means for closing the region to the rear of said roller between the housing and the floor.

2. The tool according to claim 1, wherein said at least one first suction slot is a plurality of suction slots formed by a front comb-like shape of the first cover.

3. The tool according to claim 2, wherein said front comb-like shape has arrow-shaped teeth.

4. The tool according to claim 1, wherein said at least one second suction slot is a single suction slot that lies transversely to the main direction of motion.

5. The tool according to claim 1, wherein each of said first cover and said second cover has slotted holes for fixing it to said housing, respective T-shaped elements being insertable in said slotted holes, being rigidly coupled to said housing in corresponding regions and being rotatable about their own axis of symmetry between a position in which a head of said elements can pass through the respective hole and a position in which said head straddles said hole.

6. A multipurpose tool for cleaning machines, comprising a box-like body that is interchangeably associable with a cleaning machine provided with an electric motors said box-like body being movable on wheels connected to said box-like body, a front advancement part thereof being arranged transversely to a main direction of motion so as to form a housing that is open downward and accommodates a bristled roller that is moved, by virtue of transmission means, by an electric motor accommodated within the body, said body being articulated to a coupling element that is suitable to provide a detachable connection to the machine with a dirt suction duct, said tool further comprising a cover that is detachably associable below said housing at an open region where said roller is located, said cover having at least one suction slot arranged below said roller and closure means for closing the region to the rear of said roller between the housing and a floor, said at least one suction slot being a plurality of suction slots formed by a front comb-like shape of the cover.

7. The tool according to claim 6, wherein said front comb-like shape has arrow-shaped teeth.

* * * * *

UNITED STATES PATENT AND TRADEMARK OFFICE

CERTIFICATE OF CORRECTION

PATENT NO. : 6,983,511 B2
DATED : January 10, 2006
INVENTOR(S) : Massaro

It is certified that error appears in the above-identified patent and that said Letters Patent is hereby corrected as shown below:

The title page showing the illustrative figure should be deleted to be replaced with the attached title page.

Drawings,
Figs. 1-9, should be deleted to be replaced with drawing sheets, consisting of Figs. 1-9, as shown on the attached page.

Signed and Sealed this

Thirteenth Day of June, 2006

JON W. DUDAS
*Director of the United States Patent and Trademark Office*

(12) United States Patent
Massaro

(10) Patent No.: US 6,983,511 B2
(45) Date of Patent: Jan. 10, 2006

(54) MULTIPURPOSE TOOL FOR CLEANING MACHINES

(75) Inventor: Michele Massaro, Noventa Padovana (IT)

(73) Assignee: Lindhaus S.R.L., Padova (IT)

( * ) Notice: Subject to any disclaimer, the term of this patent is extended or adjusted under 35 U.S.C. 154(b) by 0 days.

(21) Appl. No.: 10/155,033

(22) Filed: May 28, 2002

(65) Prior Publication Data

US 2002/0178534 A1 Dec. 5, 2002

(30) Foreign Application Priority Data

May 31, 2001 (IT) ..... PD2001A0125

(51) Int. Cl.
*A47L 9/04* (2006.01)

(52) U.S. Cl. ..... 15/338; 15/328; 15/378; 15/422

(58) Field of Classification Search ..... 15/364, 15/378, 412, 328, 338, 377, 401, 402, 414, 15/420, 422

See application file for complete search history.

(56) References Cited

U.S. PATENT DOCUMENTS 1,296,121 A * 3/1919 Rosenfield ..... 15/393
1,657,111 A * 1/1928 Desnoyers ..... 15/393
4,700,428 A * 10/1987 Hetherington ..... 15/338
5,101,534 A * 4/1992 Watanabe et al. ..... 15/401
5,819,366 A * 10/1998 Edin ..... 15/401
6,101,668 A * 8/2000 Grey ..... 15/401

* cited by examiner

*Primary Examiner*—Theresa T. Snider
(74) *Attorney, Agent, or Firm*—Guido Modiano; Albert Josif; Daniel O'Byrne

(57) ABSTRACT

A multipurpose tool for cleaning machines, having a body that is interchangeably associable with a cleaning machine provided with an electric motor; the body is movable on wheels and a front advancement part thereof is arranged transversely to a main direction of motion so as to form a housing that is open downward and accommodates a bristled roller that is moved, by virtue of transmission elements, by an electric motor accommodated within the body; the body is articulated to a coupling element that is suitable to provide a detachable connection to the machine with a dirt suction duct. The tool further includes a pair of interchangeable covers that are selectively detachably associable below the housing at an open region where the roller is located, each of the covers having at least one suction slot and elements for closing the region to the rear of the roller between the housing and the floor.

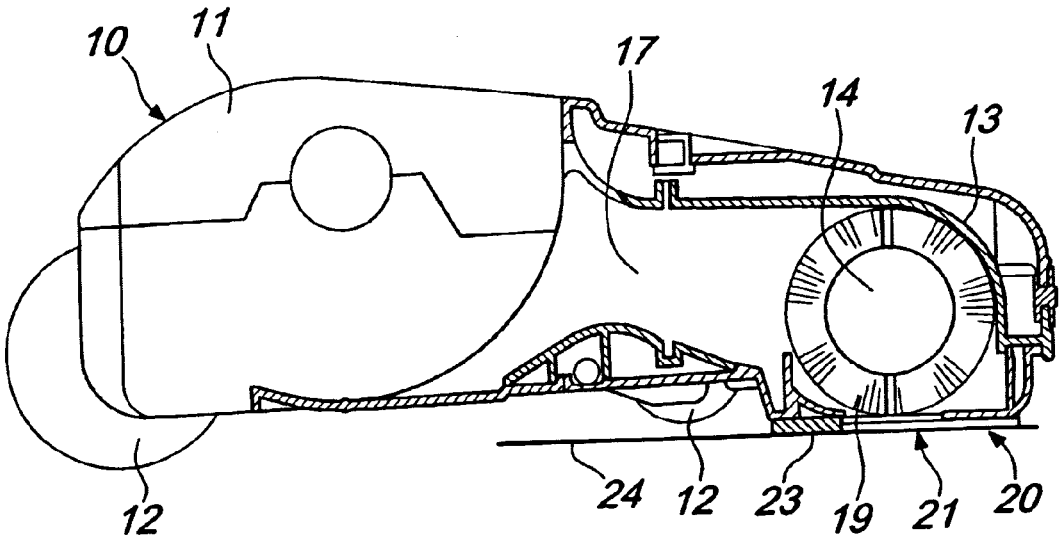

7 Claims, 4 Drawing Sheets